US006196952B1

(12) United States Patent
Chen

(10) Patent No.: US 6,196,952 B1
(45) **Date of Patent: *Mar. 6, 2001**

(54) ADJUSTABLE DUMBBELL

(76) Inventor: James Chen, No. 35, Tun Hi Rd., Chin Chan Li, Sa Lu, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/263,846

(22) Filed: Mar. 8, 1999

(51) Int. Cl.[7] ..... A63B 21/075
(52) U.S. Cl. ..... 482/107; 482/108; 482/98
(58) Field of Search ..... 482/93, 97, 98, 482/908, 106–108

(56) References Cited

U.S. PATENT DOCUMENTS

| | | | | |
|---|---|---|---|---|
| D. 359,778 | * | 6/1995 | Towley, III et al. | D21/682 |
| D. 422,654 | * | 4/2000 | Chen | D21/681 |
| 4,529,198 | * | 7/1985 | Hettick, Jr. | 482/107 |
| 5,637,064 | * | 6/1997 | Olson et al. | 482/108 |
| 5,769,762 | * | 6/1998 | Towley, III et al. | 482/108 |
| 5,779,604 | * | 7/1998 | Towley, III et al. | 482/108 |
| 5,971,899 | * | 10/1999 | Towley, III et al. | 482/108 |
| 6,033,350 | * | 3/2000 | Krull | 482/108 |
| 6,039,678 | * | 3/2000 | Dawson | 482/108 |
| 6,083,144 | * | 7/2000 | Towley, III et al. | 482/108 |
| 6,099,442 | * | 8/2000 | Krull | 482/108 |

* cited by examiner

*Primary Examiner*—John Mulcahy
*Assistant Examiner*—Victor K. Hwang
(74) *Attorney, Agent, or Firm*—Browdy and Neimark

(57) ABSTRACT

A dumbbell comprises a carrying seat, a plurality of weights, and a weight-adjusting device. The carrying seat is formed of two parallel plates, two hollow rods and a grip. The plates are provided with a receiving cell, a through holes, and a plurality of grooves. Each of the weights has two identical block bodies which are provided with two through holes and a plurality of grooves. Two connection rods are disposed between the bottoms of the two block bodies and are different in length to facilitate the juxtaposing of the weights. The weight-adjusting device comprises an adjustor, and four pins which can be extracted from or retracted into the plates such that the pins are received at one end thereof in the through holes of certain block bodies, thereby coupling the carrying seat with a desired number of the weights.

10 Claims, 7 Drawing Sheets

ADJUSTABLE DUMBBELL

FIELD OF THE INVENTION

The present invention relates generally to an exercise device, and more particularly to an adjustable dumbbell for muscular exercise.

BACKGROUND OF THE INVENTION

The conventional dumbbell of the most primitive type is integrally made of a metal material by casting and is therefore provided with a fixed weight. The conventional dumbbell of the more advanced type is provided with a plurality of round weights joined by a short bar by which it is lifted or swung about in the hand for muscular exercise. Such a dumbbell is therefore adjustable in weight. The round weights are movable and can therefore fall on the ground accidentally to inflict a wound on the dumbbell user or bystanders.

In order to overcome the shortcomings of the conventional dumbbells described above, a prior art dumbbell is provided with a plurality of rectangular weights. The number of weights that can be lifted along with the dumbbell main body can be easily manipulated by changing the position of a fastening pin in a groove. In light of the fastening pin being located in the groove insecurely, the weights can accidentally fall on the ground at the time when the dumbbell is in use. After the prolonged use of the dumbbell, the fastening pin is vulnerable to deformation, thereby causing the fastening pin to unable to press securely against the connection rod of the weights.

SUMMARY OF THE INVENTION

The primary objective of the present invention is to provide an improved dumbbell free from the deficiencies of the prior art dumbbells described above.

The foregoing objective of the present invention is attained by a dumbbell comprising a carrying seat, a plurality of weights, and a weight-adjusting device. The carrying seat is formed of two parallel plates, two hollow rods and a grip. The parallel plates are provided with a receiving cell, a through hole, and a plurality of grooves. Each of the weights has two identical block bodies which are provided with two through holes and a plurality of grooves. Two connection rods are disposed between the bottoms of the two block bodies and are different in length to facilitate the juxtaposing of the weights. The weight-adjusting device comprises an adjustor, and four pins which can be extracted from or retracted into the plates such that the pins are received at one end thereof in the through holes of certain block bodies, thereby coupling the carrying seat with a desired number of the weights.

The foregoing objective, features, and functions of the present invention will be more readily understood upon a thoughtful deliberation of the following detailed description of two preferred embodiments of the present invention with reference to the accompanying drawings.

DETAILED DESCRIPTION OF THE INVENTION

Figure 1:
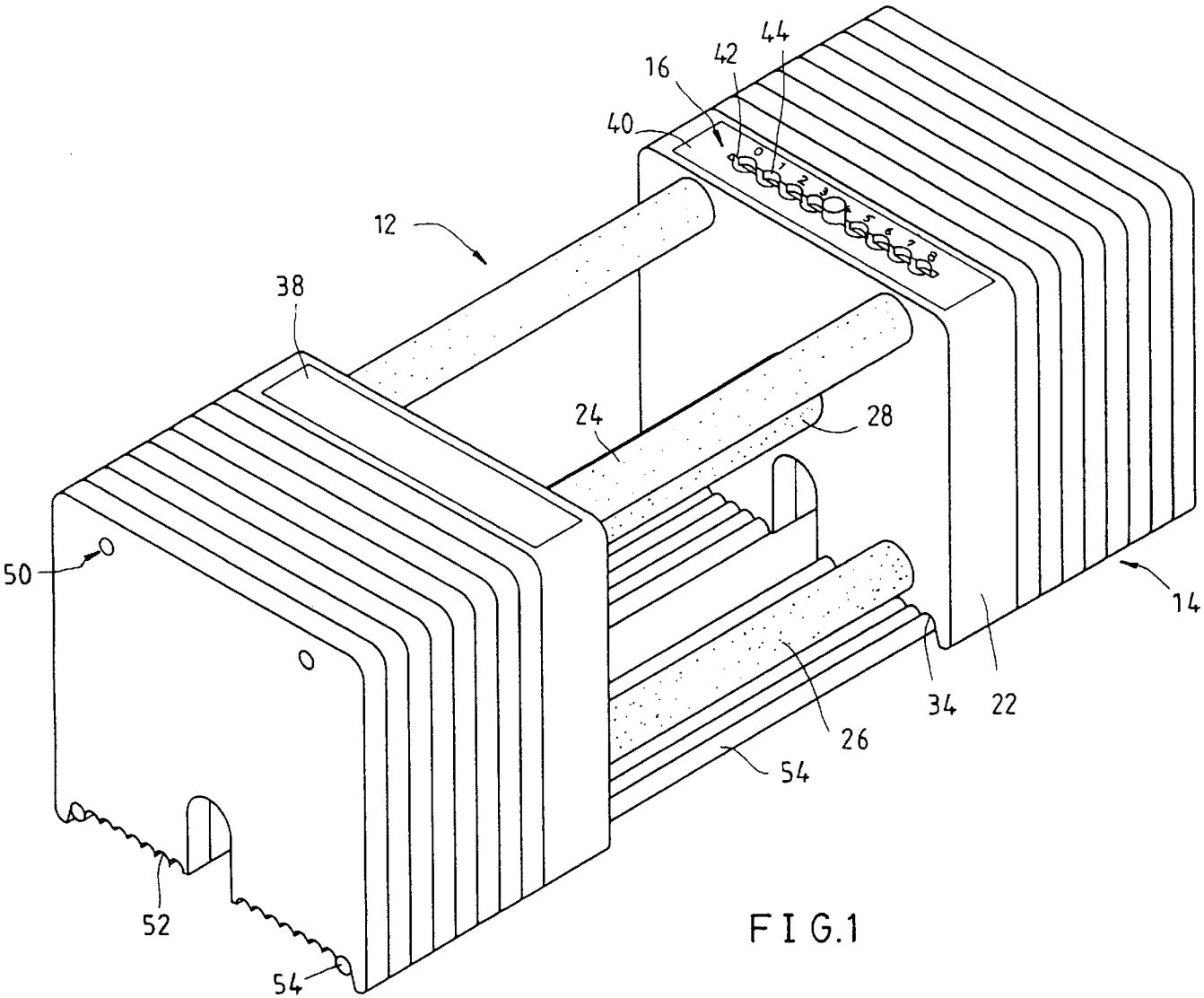
FIG. 1 shows a perspective view of a first preferred embodiment of the present invention.
Figure 2:
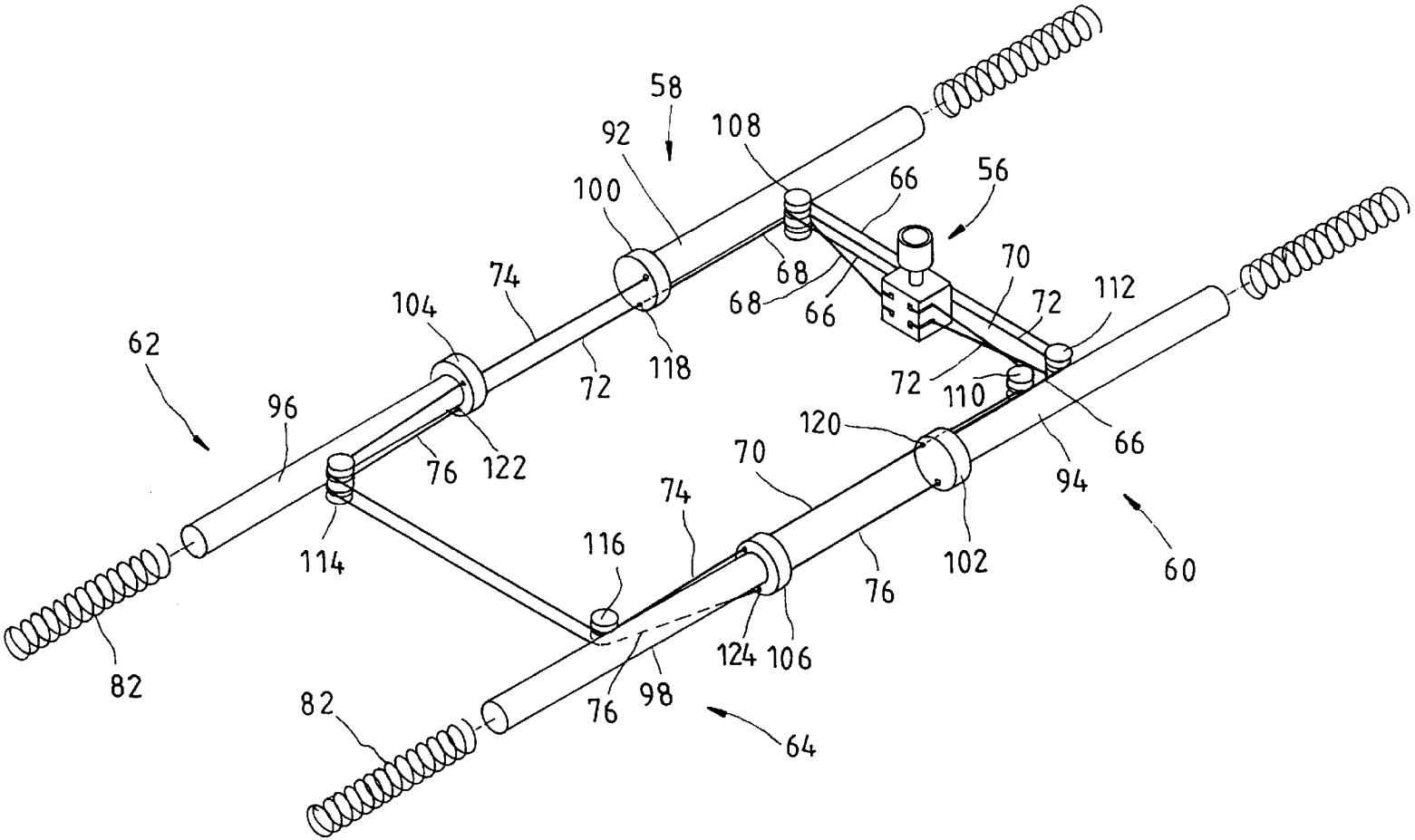
FIG. 2 shows a perspective view of a weight-adjusting device of the first preferred embodiment of the present invention.
Figure 3:
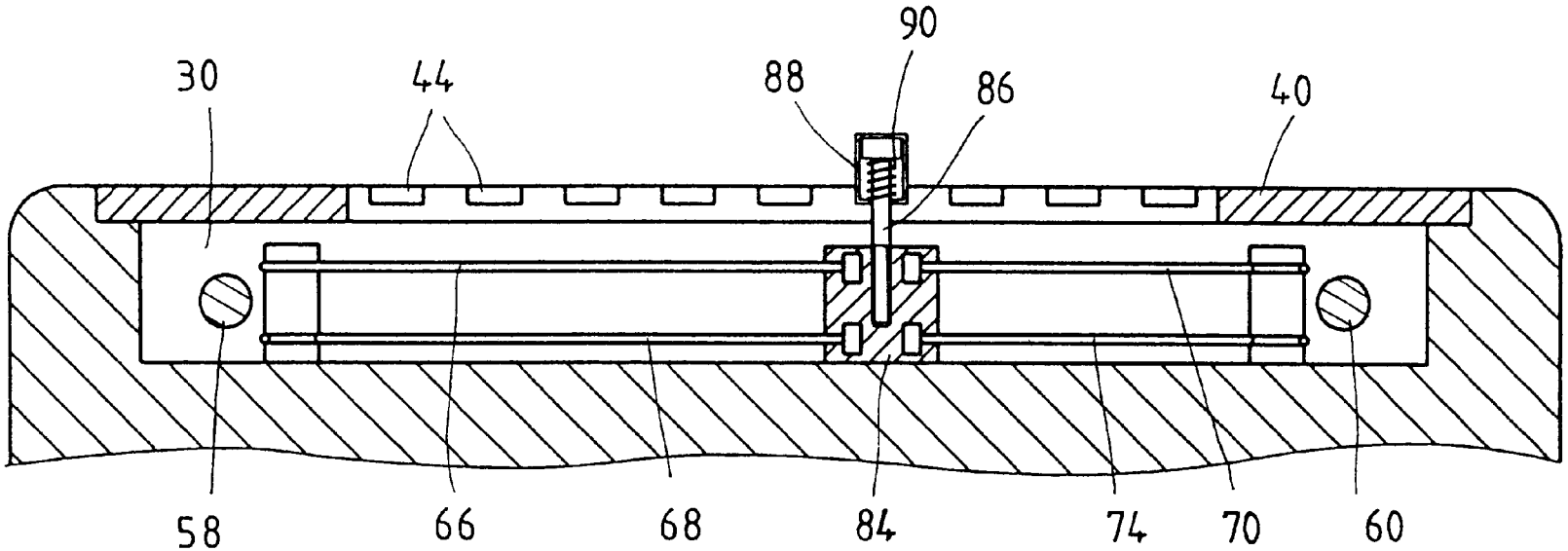
FIG. 3 shows a partial schematic view of the first preferred embodiment of the present invention.

As shown in FIGS. 1, 2, and 3, a dumbbell of the first preferred embodiment of the present invention comprises a carrying seat 12, a plurality of weights 14, and a weight-adjusting device 16.

The carrying seat 12 is formed of two plates 22, two hollow rods 24, two support rods 26, and a grip 28. The plates 22 are provided at the top thereof with a receiving cell 30 (32), and in the bottom thereof with a plurality of carrying grooves 34. Each plate 22 is provided with a through hole 36 which is corresponding in location to the hollow rod 24 and in communication with the receiving cells 30 and 32. The receiving cells 30 and 32 are covered respectively by the cover plates 38 and 40 which are provided with a guide slot 42, and nine fisheye cavities 44 designated by the reference numerals of 0, 1, 2, 3, 4, 5, 6, 7, and 8.

Each of the weights 14 has two metal block bodies 48 identical in shape to each other. Each block body 48 is provided at both ends of the top thereof with a through hole 50, and at the bottom thereof with a plurality of carrying grooves 52 each having an opening that faces downward. Connected between the bottoms of the two block bodies 48 are two connection rods 54 which are parallel to each other and different in length and position for each weight, thereby enabling the weights 14 to be juxtaposed such that the block bodies 48 are corresponding to one another and enabling the connection rods 54 to press against the carrying grooves 52. The carrying seat 12 can be disposed between the block body 48 and the connection rod 54 such that the plate body 22 is corresponding to the block body 48, and that the connection rod 54 presses against the carrying groove 34.

The weight-adjusting device 16 is composed of an adjustor 56, four pins 58, 60, 62, and 64, six cords 66, 68, 70, 72, 74, and 76, two steering mechanisms 78 and 80, and four elastic members 82. The adjustor 56 has a seat body 84 which is disposed in the receiving cell 30 such that a top end 86 thereof is jutted out of the guide slot 42. The top end 86 is fitted into a cap 88 corresponding in location to one fisheye cavity 44. A spring 90 is disposed between the top end 86 and the cap 88 for causing the cap 88 to press constantly against a predetermined fisheye cavity 44 at the time when the cap 88 is not exerted on by an external force. The pins 58, 60, 62 and 64 have a shank 92, 94, 96, 98 and a head 100, 102, 104, 106. The pins are received in pair in the hollow rods 24 such that the heads are corresponding to each other and that the shanks are received at one end thereof in the through hole 36 of the plates 22. The two steering mechanisms 78 and 80 are respectively disposed in the receiving cells 30 and 32. The first steering mechanism 78 has three rotary wheels 108, 110, and 112, whereas the second steering mechanism 80 has two rotary wheels 114 and 116. The cords are metal wires. The first and the second cords 66 and 68 are fastened at one end thereof with the seat body 84 such that other ends of the cords 66 and 68 are fastened respectively with the heads 100 and 102 of the pins 58 and 60 via the rotary wheel 108. In the meantime, the third and the fourth cords 70 and 72 are fastened respectively at one end thereof with the seat body 84 such that other ends of the cords 70 and 72 are fastened respectively with the heads 106 and 104 of the pins 64 and 62 via the rotary wheels 108 and 110, and via the holes 118 and 120 of the heads 100 and 102 of the pins 58 and 60. The fifth cord 74 is fastened at one end thereof with the head 100 of the pin 58 and is then fastened with the head 106 of the pin 64 via the hole 122 of the head 104 of the pin 62, and via the rotary wheels 114 and 116. The sixth cord 76 is fastened at one end thereof with the head 102 of the pin 60 and is then fastened with the head 104 of the pin 62 via the hole 124 of the head 106 of the pin 64 and via the rotary wheels 116 and 114. The elastic members 82 are springs which are fitted over respectively the shanks 92, 94, 96, and 98 of the pins 58, 60, 62, and 64 such that the springs are respectively located between the heads 100, 102, 104, and 106 of the pins 58, 60, 62 and 64 and the plate 22.

Figure 4:
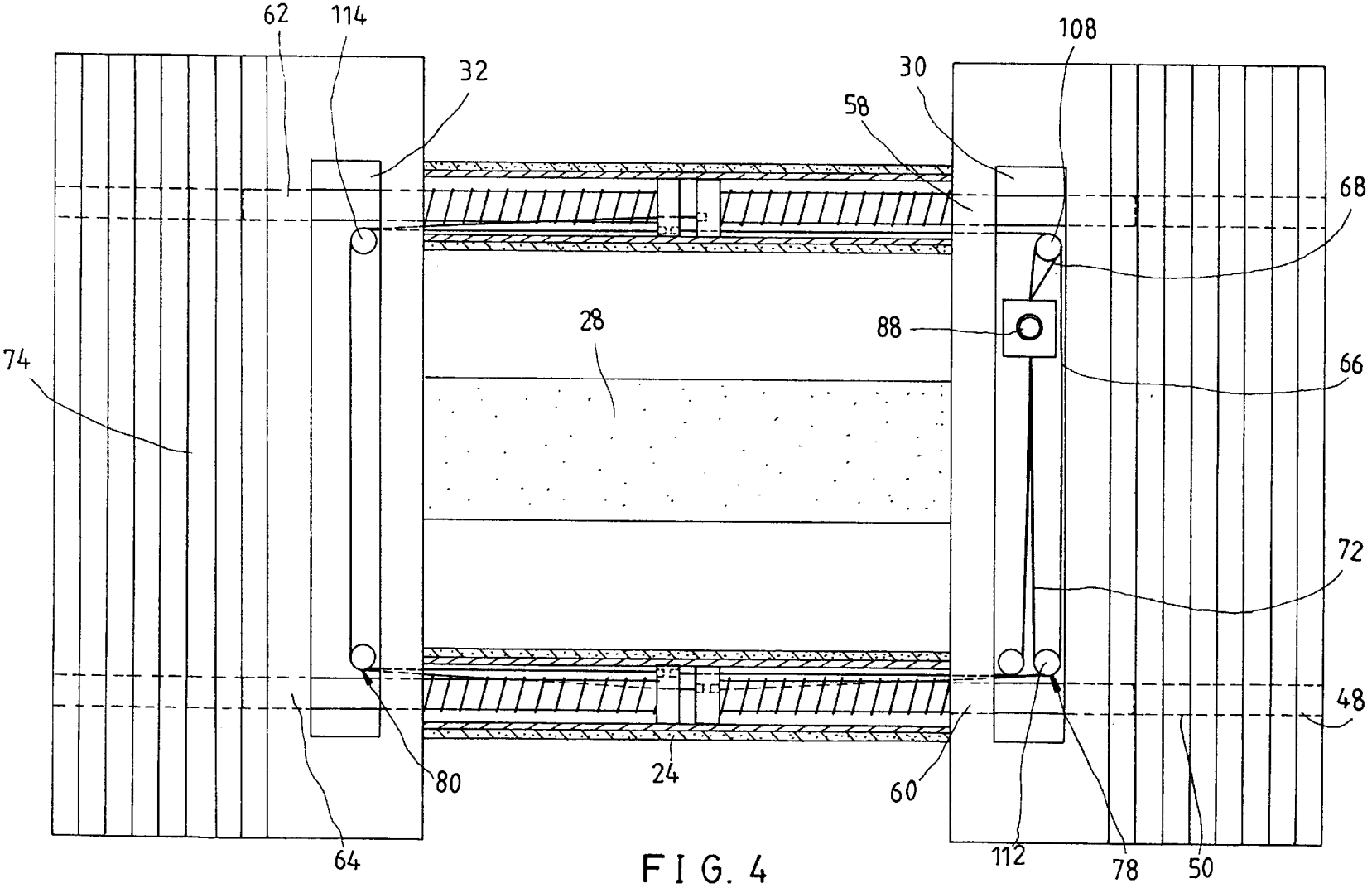
FIGS. 4 and 5 are schematic views of the first preferred embodiment of the present invention in action.
Figure 5:
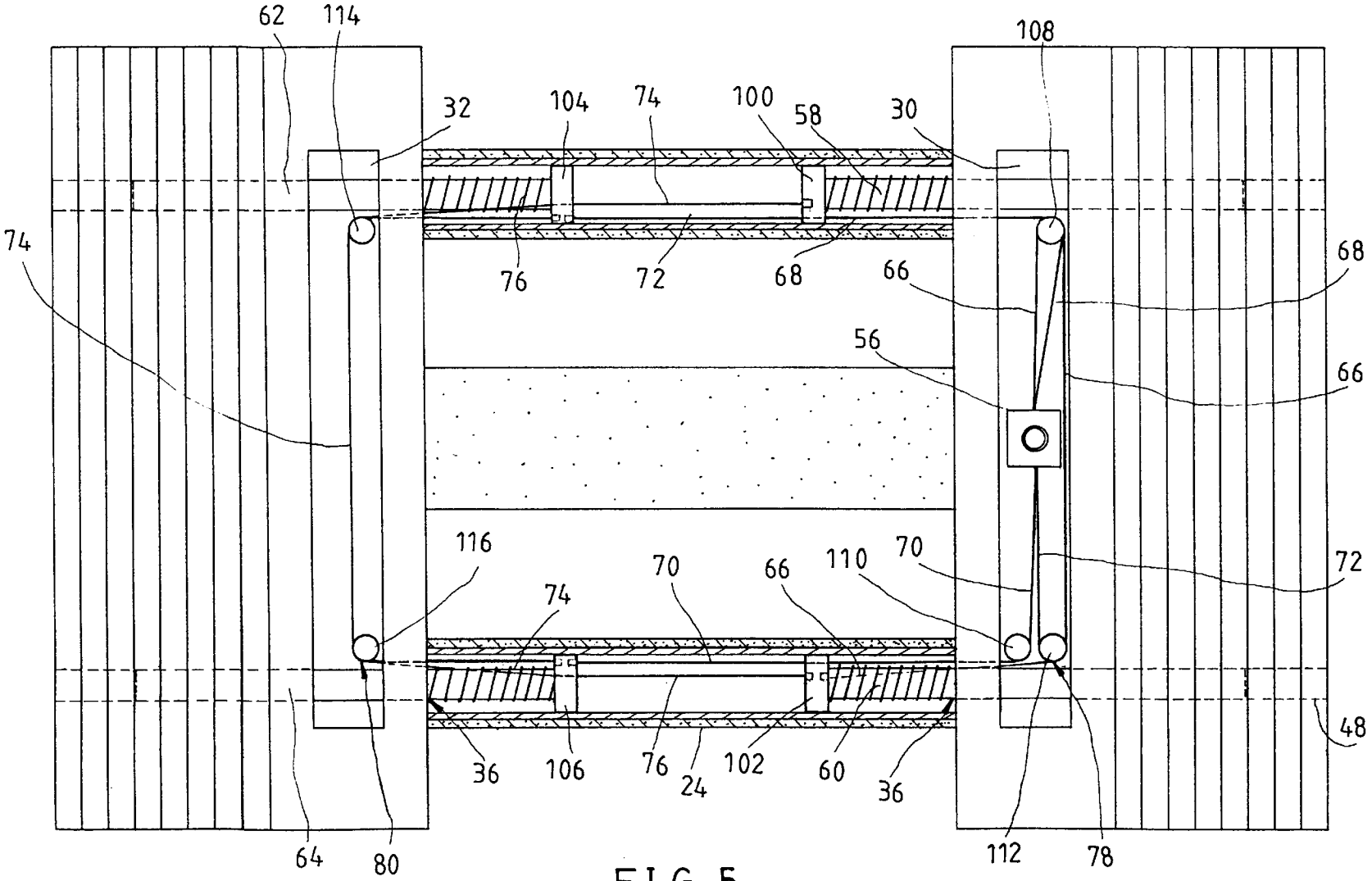

As shown in FIG. 4, when the cap 88 is located at the fisheye cavity 44 which is designated with the reference numeral of 1, the ends of the pins 58, 60, 62 and 64 are jutted out of the plate 22 to be received in the through hole 50 of the block body 48 of the first weight 14. As the carrying seat 12 is lifted by an exerciser, a weight 14 is lifted. As shown in FIG. 5, when the adjustor 56 is moved to the fisheye cavity 44 which is designated with the reference numeral of 5, the first and the second cords 66 and 68 are pulled tightly so as to pull the pins 58 and 60, which are therefore jutted out of the plate 22. When the pins 58 and 60 are jutted out in the direction toward the outer side of the plate 22, the fifth and the sixth cords 74 and 76 are also pulled to cause the pins 62 and 64 to be jutted out of the plate 22. As a result, the pins 58, 60, 62, and 64 extend simultaneously into the through holes 50 of the block bodies 48 of five weights 14, so as to enable the exerciser to lift five weights 14. On the contrary, when the adjustor 56 is moved in reverse by the exerciser, the first and the second cords 66 and 68 are loosened. In the meantime, the third and the fourth cords 70 and 72 are tightened to enable the pins 62 and 64 to be pulled back into the hollow rods 24 by the third and the fourth cords 70 and 72. When the pins 62 and 64 are retracted into the hollow rods 24, the fifth and the sixth cords 74 and 76 can be pulled to move so as to enable the pins 58 and 60 to be pulled back into the hollow rods 24 by the fifth and the sixth cords 74 and 76. In other words, the exerciser is capable of lifting a desired number of weights 14 by moving the adjustor 56 to cause the pins 58, 60, 62, and 64 to extract from or retract into the plate 22.

Figure 6:
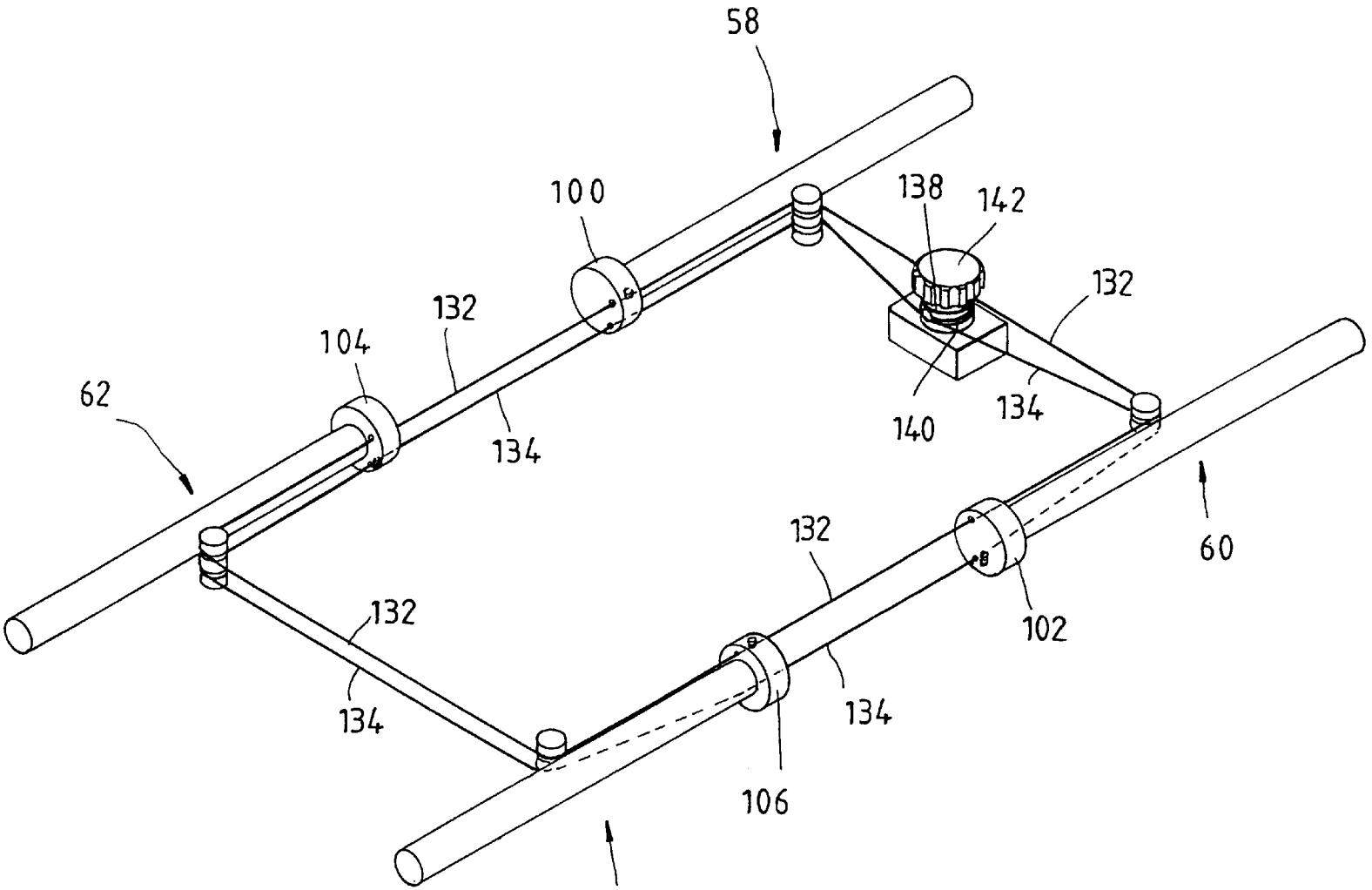
FIG. 6 shows a perspective view of a second preferred embodiment of the present invention.
Figure 7:
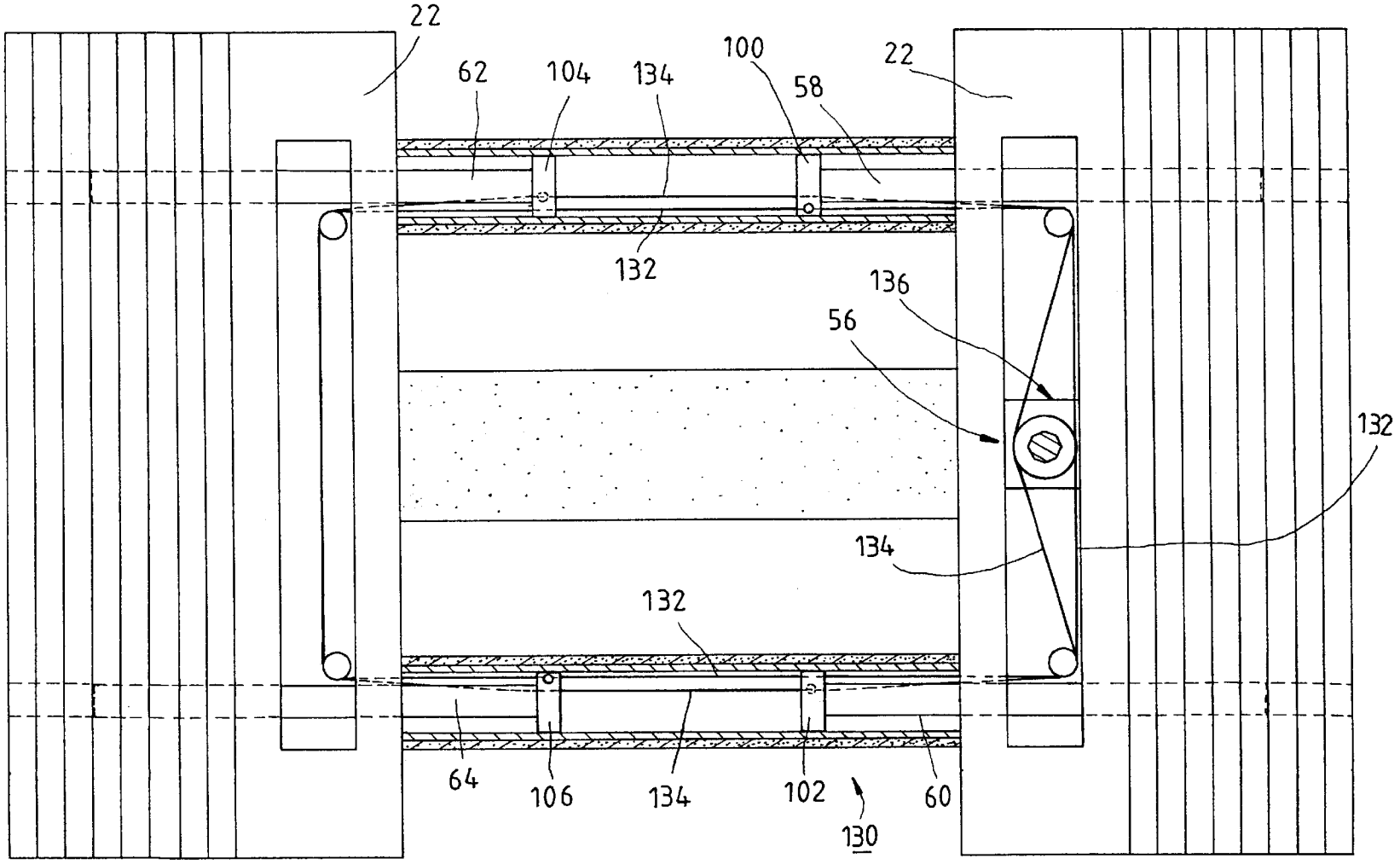
FIG. 7 shows a schematic view of the second preferred embodiment of the present invention in action.

As shown in FIGS. 6 and 7, a dumbbell 130 of the second preferred embodiment of the present invention is basically similar in construction to the dumbbell 10 of the first preferred embodiment of the present invention, except that the adjustor 56 of the dumbbell 130 is a conventional rotary knob capable of a multi-way adjustment, such as an 8-way adjustment in the second preferred embodiment of the present invention, and that it has two cords 132 and 134, and further that the adjustor 56 is inserted into a fisheye cavity (not shown in the drawings) of the receiving cell 30. The cord 132 is fastened with a shaft sleeve 138 of the adjustor 56 via the heads 100, 102, 104, and 106 of the pins 58, 60, 62, and 64 such that the cord 132 is suppressed by a sunk screw in the heads 100 and 106 of the pins 58 and 64. The cord 134 is fastened with a shaft sleeve 140 via the heads 100, 162, 104, and 106 such that the cord 134 is suppressed by a sunk screw in the heads 102 and 104 of the pins 60 and 62.

When the rotary cover 142 of the adjustor 56 is turned clockwise four steps, the cord 132 is actuated by the shaft sleeve 138 to move clockwise. As a result, the pins 58 and 64 are actuated by the cord 132 to jut out of the plate 22. In the meantime, the cord 134 is actuated by the shaft sleeve 140 to move counterclockwise, thereby pulling the pins 60 and 62 to jut out of the plate 22 to enable the exerciser to lift four weights. If the rotary cover 142 is turned counterclockwise, the cords 132 and 134 are moved in reverse to pull the pins 58, 60, 62, and 64 back into the plates 22. It is therefore readily apparent the pins can be pulled to move by the cords 132 and 134 by turning the rotary cover 142, without the use of the elastic members 82 of the first preferred embodiment of the present invention.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A dumbbell comprising:

a carrying seat formed of two parallel plates, two hollow rods and a grip, each of said plates provided at a top thereof with a receiving cell, through holes corresponding in location to said hollow rods, and a plurality of carrying grooves at a bottom thereof;

a plurality of weights each having a pair of block bodies identical to each other and provided at a top thereof with two through holes corresponding to said through holes of said plates, each said pair of block bodies further provided at a bottom thereof with a plurality of carrying grooves and two connection rods located between bottoms of said two block bodies, said connection rods being different in length between different pairs of block bodies so as to enable said weights to be juxtaposed on said carrying seat and that said connection rods press against a predetermined carrying groove; and a weight-adjusting device disposed in said receiving cells and composed of an adjustor, at least one cord, at least one steering mechanism, and four pins disposed in pairs in said hollow rods such that said pins are corresponding in location to said through holes of said plates, and that said pins are linked with said adjustor to enable said pins to be simultaneously extracted from or retracted into said plates to be received at one end thereof in said through holes of said block bodies, thereby coupling said carrying seat with a desired number of said weights.

2. The dumbbell as defined in claim 1 further comprising two support rods disposed between said two plates.

3. The dumbbell as defined in claim 1, wherein said pins have a shank, and a head located at one end of said shank, said head having an outer diameter greater than an inner diameter of said through holes of said plates; and wherein said pins are disposed in said hollow rods such that said heads are collinearly aligned with each other and that said shanks are received in said through holes of said plates.

4. The dumbbell as defined in claim 3, wherein said heads of said pins are provided with a plurality of through holes for receiving cords.

5. The dumbbell as defined in claim 3, wherein said weight-adjusting device comprises six cords, with four out of said six cords being connected with said adjustor and said heads of said pins, and with the remaining two of said six cords being connected with said pin heads which are not aligned with each other, said weight-adjusting device further comprising four elastic members which are located between said pin heads and said plates for enabling said pins to be biased into said hollow rods at the time when said pins are not exerted on by and external force.

6. The dumbbell as defined in claim 5, wherein said weight-adjusting device further comprises two steering mechanisms which are disposed in said receiving cells; and wherein said cords are disposed on said steering mechanism.

7. The dumbbell as defined in claim 3, wherein said adjustor is a multi-way rotary knob; wherein said weight-adjusting device further comprises two cords which are fastened with a rotary shaft of said adjustor via said receiving cells of said plates, said hollow rods, and said heads of said pins; said two cords being connected with said pin heads which are not aligned with each other; and wherein said pins are extracted from or retracted into said plates by said two cords at such time when said adjustor is rotated.

8. The dumbbell as defined in claim 7, wherein said two cords are fastened in reverse with said rotary shaft of said adjustor.

9. The dumbbell as defined in claim 1, wherein one of said receiving cells of one of said plates is provided at a top thereof with a guide slot having a plurality of carrying cavities; and wherein said adjustor is moved along said guide slot and located in one of said cavities.

10. The dumbbell as defined in claim 9, wherein said adjustor has a seat body disposed in said receiving cell such that a top end of said seat body is jutted out of said guide slot, said adjustor further having a cap which is elastically and movably fitted over said seat body such that said cap is selectively retained in one of said cavities.

* * * * *